US012710233B2

(12) United States Patent
Kim et al.

(10) Patent No.: US 12,710,233 B2
(45) Date of Patent: Aug. 18, 2026

(54) HEAT EXCHANGER

(71) Applicant: LG ELECTRONICS INC., Seoul (KR)

(72) Inventors: Sungwoo Kim, Seoul (KR); Hongseong Kim, Seoul (KR); Seungmo Jung, Seoul (KR); Hanchoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 156 days.

(21) Appl. No.: 18/581,927

(22) Filed: Feb. 20, 2024

(65) Prior Publication Data

US 2024/0280327 A1 Aug. 22, 2024

(30) Foreign Application Priority Data

Feb. 20, 2023 (KR) ..... 10-2023-0021972

(51) Int. Cl.
*F28D 9/00* (2006.01)

(52) U.S. Cl.
CPC ..... *F28D 9/0075* (2013.01)

(58) Field of Classification Search
CPC ..... F28D 9/0075; F28D 9/0068; F28D 9/0062
USPC ..... 165/166
See application file for complete search history.

(56) References Cited

U.S. PATENT DOCUMENTS 4,274,482 A * 6/1981 Sonoda ..... F28D 1/0333 165/176
5,101,891 A * 4/1992 Kadle ..... F28F 3/04 165/152
5,447,194 A * 9/1995 Hayashi ..... F28F 3/025 165/149
5,553,664 A * 9/1996 Nishishita ..... F28D 1/0341 165/173
5,875,834 A * 3/1999 Brooks ..... F28D 1/0333 165/DIG. 465
5,918,664 A * 7/1999 Torigoe ..... F25B 39/022 165/76
5,964,282 A * 10/1999 Seiler ..... F28F 9/001 165/170
6,145,587 A * 11/2000 Hanafusa ..... F28D 1/0341 165/174

(Continued)

FOREIGN PATENT DOCUMENTS

CN 109974487 A 7/2019
DE 20 2010 014 365 U1 3/2011

(Continued)

*Primary Examiner* — Claire E Rojohn, III
(74) *Attorney, Agent, or Firm* — Birch, Stewart, Kolasch & Birch, LLP

(57) ABSTRACT

A heat exchanger includes a plurality of fins each having an opening formed in an upper portion thereof and an opening formed in a lower portion thereof to allow a refrigerant to flow and being provided therein with a flow path through which the refrigerant flows, the plurality of fins being arranged at intervals in one direction; and a header formed at each of the upper portions and lower portions of the plurality of fins, the header being in communication with the flow path. At least one fin, among the plurality of fins, is configured such that at least one of the opening in the upper portion and the opening in the lower portion is closed.

11 Claims, 14 Drawing Sheets

(56) References Cited

U.S. PATENT DOCUMENTS 6,408,940 B1 * 6/2002 Naji ..... F28F 9/0214 165/906
6,484,797 B2 * 11/2002 Saito ..... F28F 9/0273 165/174
6,607,026 B1 * 8/2003 Naji ..... F28D 1/0333 165/906
6,698,509 B2 * 3/2004 Rong ..... F28D 1/0341 165/174
6,796,374 B2 * 9/2004 Rong ..... F28F 9/027 165/174
6,889,758 B2 * 5/2005 Burgers ..... F28F 13/06 165/170
7,013,952 B2 * 3/2006 Park ..... F28D 1/0341 165/176
7,017,656 B2 * 3/2006 Beddome ..... F28F 9/0273 165/81
7,059,395 B2 * 6/2006 Bousquet ..... F28F 9/027 165/176
7,219,717 B2 * 5/2007 Hanafusa ..... F25B 39/022 165/174
7,469,554 B2 * 12/2008 Martins ..... F28D 9/005 62/506
8,678,077 B2 * 3/2014 Shore ..... F28D 1/0325 165/166
9,581,397 B2 * 2/2017 Samuelson ..... F28F 9/0131
10,113,817 B2 * 10/2018 Spryshak ..... F28F 13/12
10,156,401 B2 * 12/2018 Blanchard ..... F28D 9/0006
10,962,309 B2 * 3/2021 Takagi ..... F28D 1/0333
10,989,481 B2 * 4/2021 Crawford ..... F28D 9/0093
11,073,342 B2 * 7/2021 Yamada ..... F28F 1/32
11,236,954 B2 * 2/2022 Takafuji ..... F28D 1/05333
12,188,724 B2 * 1/2025 Kim ..... F28F 9/0209
2006/0144051 A1 * 7/2006 Mehendale ..... F28D 1/0341 62/3.2
2011/0011568 A1 * 1/2011 Han ..... F28F 3/046 165/166
2015/0114030 A1 * 4/2015 Park ..... F28D 1/05358 62/507
2015/0226495 A1 * 8/2015 Park ..... F28F 1/128 165/151
2016/0091253 A1 * 3/2016 Spryshak ..... F28F 13/12 165/166
2022/0120503 A1 * 4/2022 Kim ..... B21D 53/04
2023/0095820 A1 * 3/2023 Rhee ..... F28F 3/04 165/166
2024/0011722 A1 * 1/2024 Kim ..... B23P 15/26
2024/0210123 A1 * 6/2024 Jung ..... F28D 1/0333
2024/0280327 A1 * 8/2024 Kim ..... F28D 1/0333

FOREIGN PATENT DOCUMENTS

IT 102018000005663 A1 11/2019
JP 2004-101110 A 4/2004
KR 10-1148925 B1 5/2012
KR 10-2021-0055338 A 5/2021
KR 10-2022-0113117 A 8/2022

* cited by examiner

HEAT EXCHANGER

CROSS-REFERENCE TO RELATED APPLICATIONS

This non-provisional application claims the benefit under 35 U.S.C. § 119(a) to Patent Application No. 10-2023-0021972, filed in the Republic of Korea on Feb. 20, 2023, all of which is hereby expressly incorporated by reference into the present application.

BACKGROUND

1. Technical Field

The present disclosure relates to a heat exchanger that has high heat efficiency and allows a flow path to be changed in various manners.

2. Description of the Related Art

In general, a heat exchanger can be used as a condenser or an evaporator in a refrigeration cycle device consisting of a compressor, a condenser, an expansion mechanism, and an evaporator. A heat exchanger can be installed in a vehicle, a refrigerator, and the like to exchange heat between refrigerant and air.

Heat exchangers can be classified into a fin-tube type heat exchanger, a micro-channel type heat exchanger, and the like.

There are different types of heat exchangers, such as a fin-tube heat exchanger, a micro-channel heat exchanger, etc. Such heat exchangers may include a tube through which refrigerant passes and a header connected to the tube so as to distribute the refrigerant to the tube.

In the case of the fin-tube type heat exchanger, a fin for heat exchange may be coupled to a tube through which refrigerant passes. The fin-tube type heat exchanger may be configured such that a plurality of tubes having a tubular shape passes through a plurality of fins having a plate shape, or the fin and the tube are integrally formed with each other.

Air may pass between the fin and the tube of the fin-tube type heat exchanger. As the air passes between the fin and the tube, the air may exchange heat with the refrigerant flowing through the tube.

Meanwhile, research has been conducted to address a problem such as the flow rate or resistance of air passing through the fin-tube type heat exchanger and to increase the amount and efficiency of heat exchange.

Korean Laid-Open Patent Publication No. 2021-0055338, which is hereby incorporated by reference, discloses a heat exchanger in which a tube and a fin are formed as one body, and a flow path is provided through a tube connecting a first header and a second header. However, since a separate header is required to provide the flow path, the structure is complicated.

In order to solve this problem, a fin-tube-header integrated heat exchanger has been proposed, which is not suitable for implementing various flow paths unless a separate header is provided. This is disadvantageous to form different flow paths according to the role of the heat exchanger.

RELATED ART

Patent Document

Korean Laid-Open Patent Publication No. 2021-0055338 (published on: May 17, 2021)

SUMMARY

It is an objective of the present disclosure to provide a heat exchanger that is easy to manufacture, has high heat exchange efficiency, and has low air flow resistance.

It is another objective of the present disclosure to provide a heat exchanger that enables a header to be integrated with a fin-tube integrated heat exchanger.

It is yet another objective of the present disclosure to provide a heat exchanger that enables various designs for a flow path by selectively opening an opening portion that defines a header of each fin of a fin-tube integrated heat exchanger.

It is yet another objective of the present disclosure to provide a heat exchanger that is optimized for its target application by inserting a fin with open and closed opening portions that define a header, according to the role (or function) of the heat exchanger.

According to one aspect of the subject matter described in this application, a heat exchanger includes: a plurality of fins each having an opening formed in an upper portion thereof and an opening formed in a lower portion thereof to allow a refrigerant to flow and being provided therein with a flow path through which the refrigerant flows, the plurality of fins being arranged at intervals in one direction; and a header formed at each of the upper portions and lower portions of the plurality of fins, the header being in communication with the flow path, wherein at least one fin, among the plurality of fins, is configured such that at least one of the opening in the upper portion and the opening in the lower portion is closed.

The header may be formed as openings of adjacent fins, of the plurality of fins, are coupled to one another in a successive manner.

Each of the plurality of fins may further include a fin collar to surround a corresponding one of the openings, the fin collar protruding by a predetermined thickness. The header may be formed as fin collars of the adjacent fins are coupled to one another in a successive manner.

The plurality of fins may include at least two types of fins among a basic fin in which the opening in the upper portion and the opening in the lower portion are both open, a series flow fin in which one of the opening in the upper portion and the opening in the lower portion is open, and a closed fin in which the opening in the upper portion and the opening in the lower portion are both closed.

The series flow fin may change a flow of the refrigerant from a parallel flow to a series flow to thereby extend a length in flow path.

The series flow fin may be disposed in a zone within the heat exchanger where refrigerant stagnation occurs.

The closed fin may be used as an end plate of the heat exchanger.

An entirety of the heat exchanger, except the series fin and the closed fin, may consist of the basic fins.

A position of the series flow fin may be changed such that a flow path varies according to a role of the heat exchanger.

When the heat exchanger is operated as a condenser, a flow path of the refrigerant may be formed such that a flow is directed from top to bottom.

When the heat exchanger is operated as a condenser, the series flow fin may be disposed such that, of a flow path of the refrigerant, a section flowing from top to bottom is greater than a section flowing from bottom to top.

When the heat exchanger is operated as a condenser, at least two series flow fins may be disposed such that a flow path of the refrigerant flows from top to bottom.

When the heat exchanger is operated as an evaporator, a flow path of the refrigerant may be formed such that a flow is directed from bottom to top.

When the heat exchanger is operated as an evaporator, the series flow fin may be disposed such that, of a flow path of the refrigerant, a section flowing from bottom to top is greater than a section flowing from top to bottom.

When the heat exchanger is operated as an evaporator, at least two series flow fins may be disposed such that a flow path of the refrigerant flows from bottom to top.

Each of the plurality of fins may be formed by coupling a first panel and a second panel that are elongated. The first panel may include a plurality of first grooves formed by protruding outward from the first panel and extending in a direction inclined with respect to a longitudinal direction of the first panel, the plurality of first grooves being arranged along the longitudinal direction of the first panel. The second panel may include a plurality of second grooves formed by protruding outward from the second panel and extending in a direction intersecting the first groove while being inclined with respect to a longitudinal direction of the second panel, the plurality of second grooves being arranged along the longitudinal direction of the second panel to face the plurality of first grooves to thereby form the flow path.

The fin collar may include: a first fin collar formed on the first panel; and a second fin collar formed on the second panel.

The first panel may include a first bending section where the first groove is bent with respect to an air flow direction. The second panel may include a second bending section bent in a direction opposite to the first groove at a position corresponding to the first bending section.

The first bending section and the second bending section may be disposed parallel to a longitudinal direction of the fin.

The first groove and the second groove may each include at least one dimple.

According to another aspect, a heat exchanger includes: a plurality of fins provided therein with a flow path through which a refrigerant flows, the plurality of fins being arranged at intervals in one direction; and a header provided at each of upper portions and lower portions of the plurality of fins, the header being in communication with the flow path, wherein one of the plurality of fins has an opening in at least one of an upper portion and a lower portion thereof.

Figure 6:
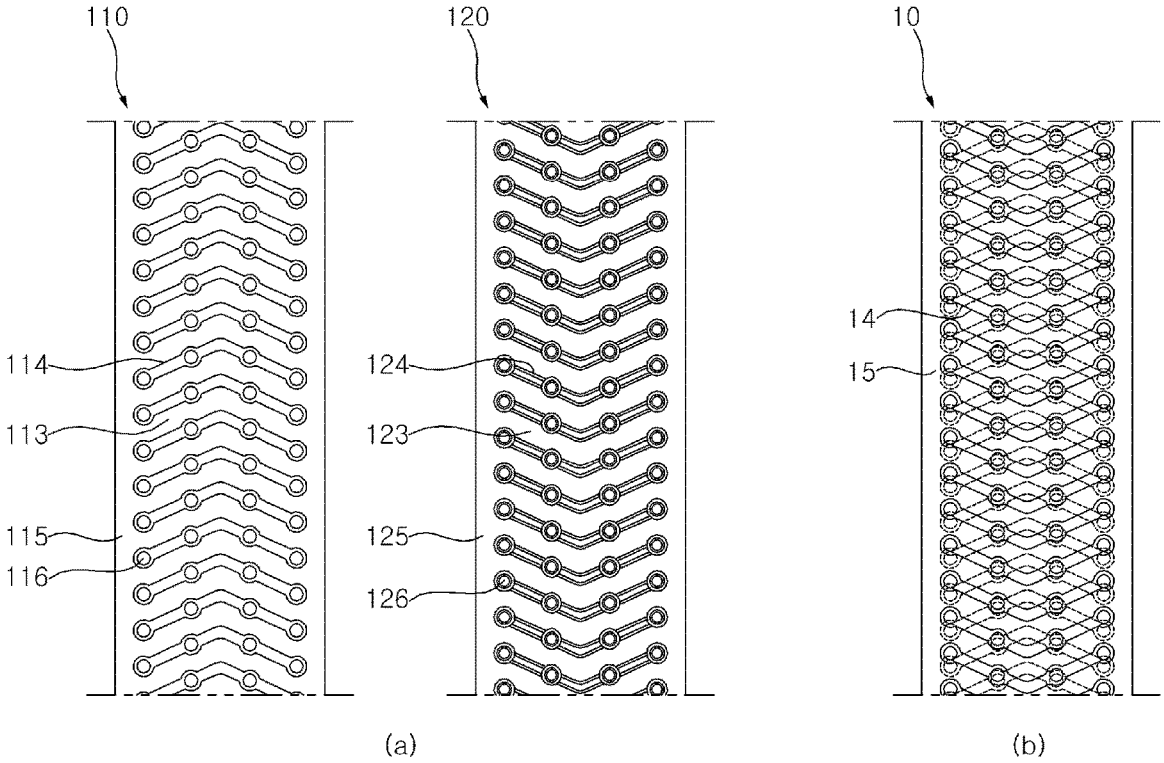

(a) of FIG. 6 illustrates a first panel and a second panel that define one fin, and (b) of FIG. 6 illustrates one fin formed by coupling the first panel and the second panel.

Figure 2:
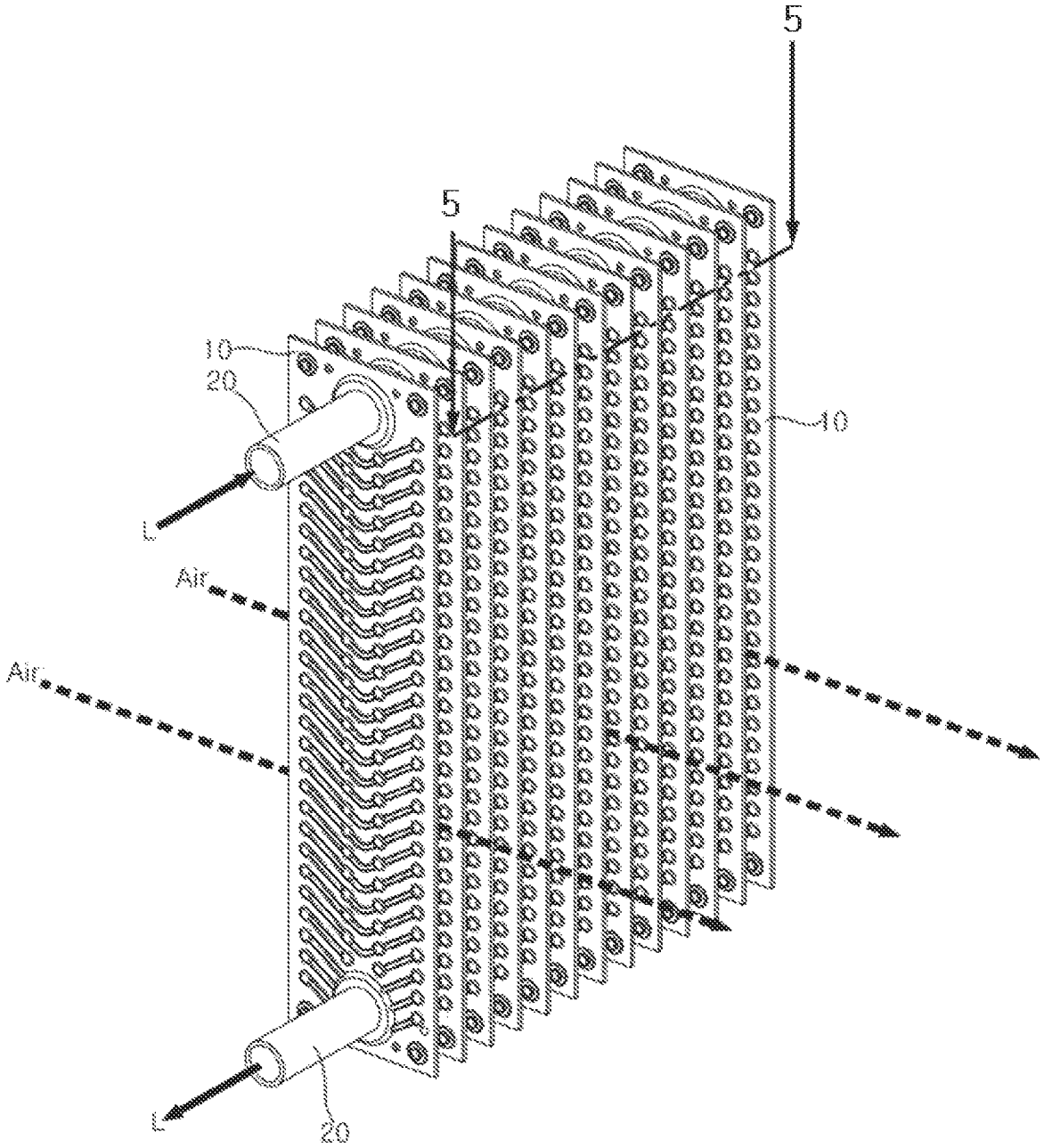
FIG. 2 is a perspective view of a heat exchanger according to an embodiment of the present disclosure.
Figure 7A:
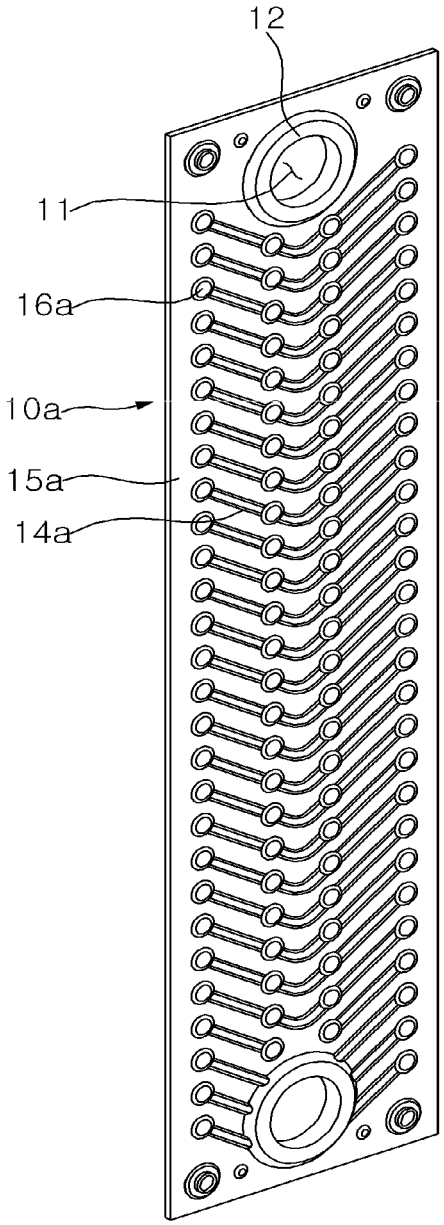
Figure 7B:
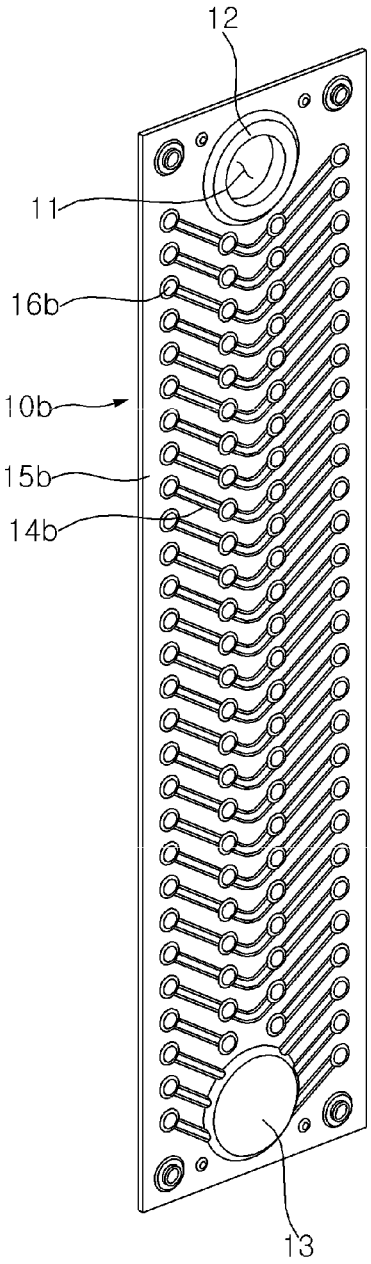
Figure 7C:
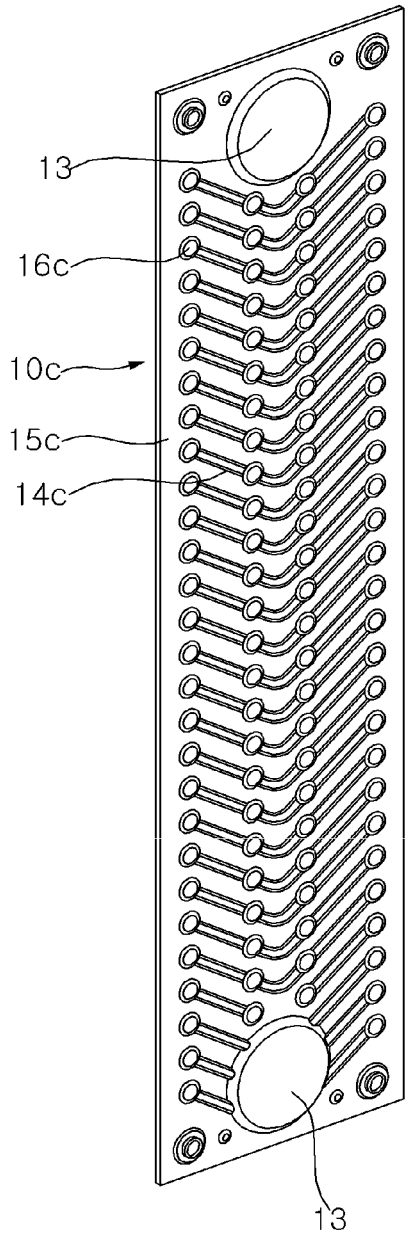

FIG. 7A to 7C illustrate examples of a plurality of fins with different headers employed in the heat exchanger of FIG. 2.

Figure 8A:
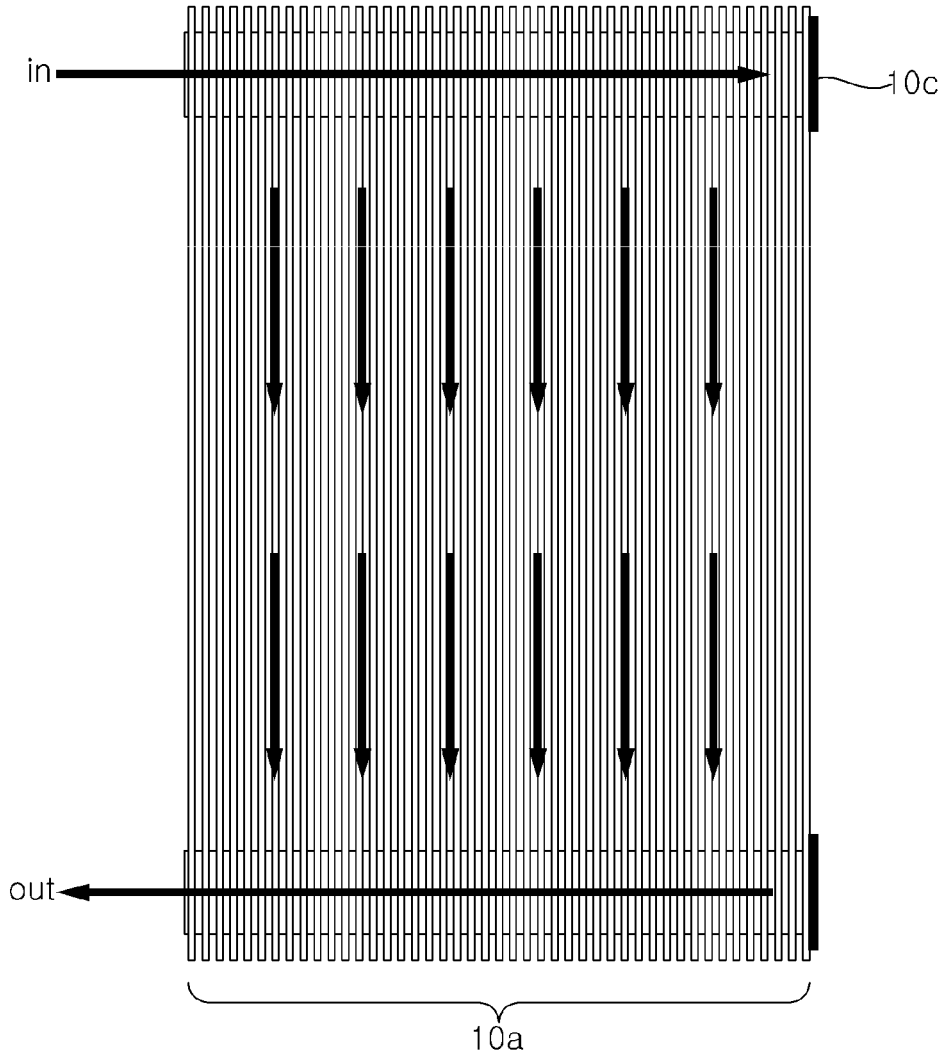
Figure 8B:
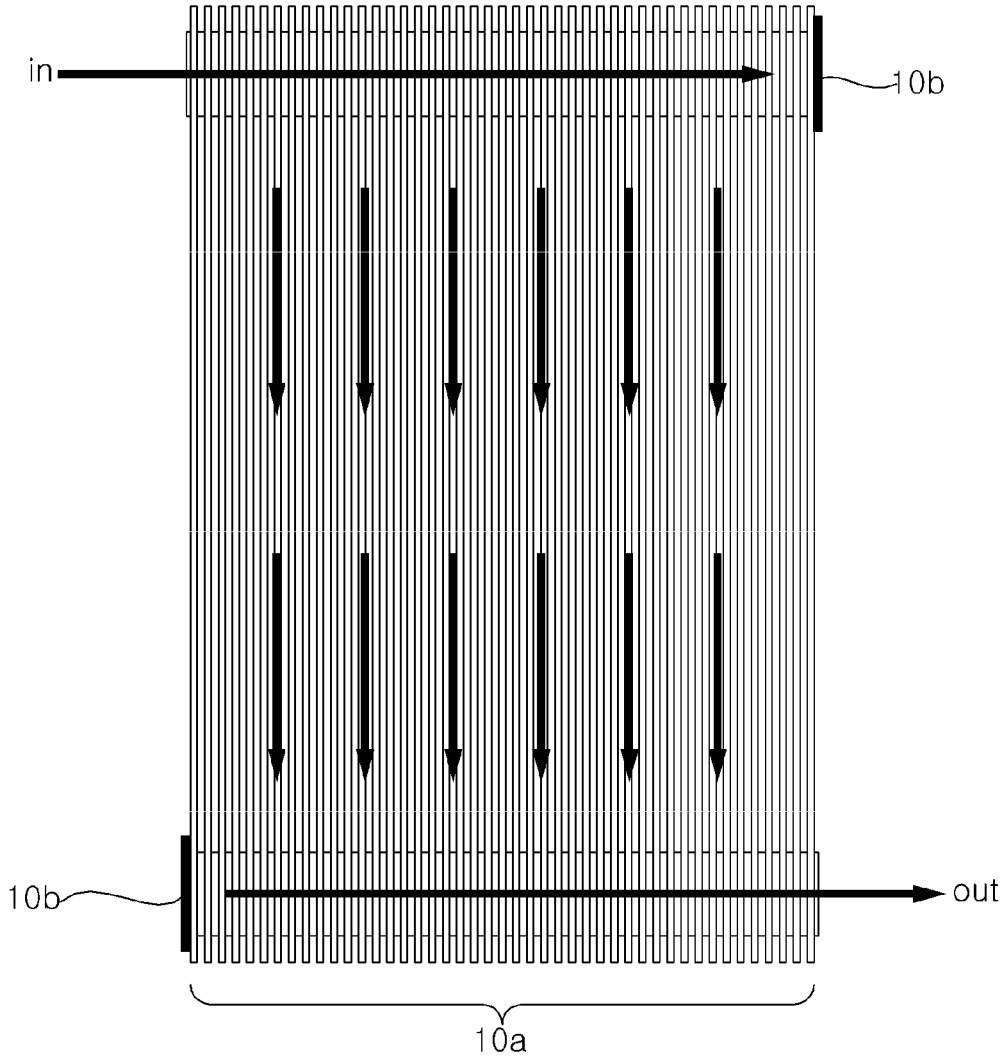
Figure 8C:
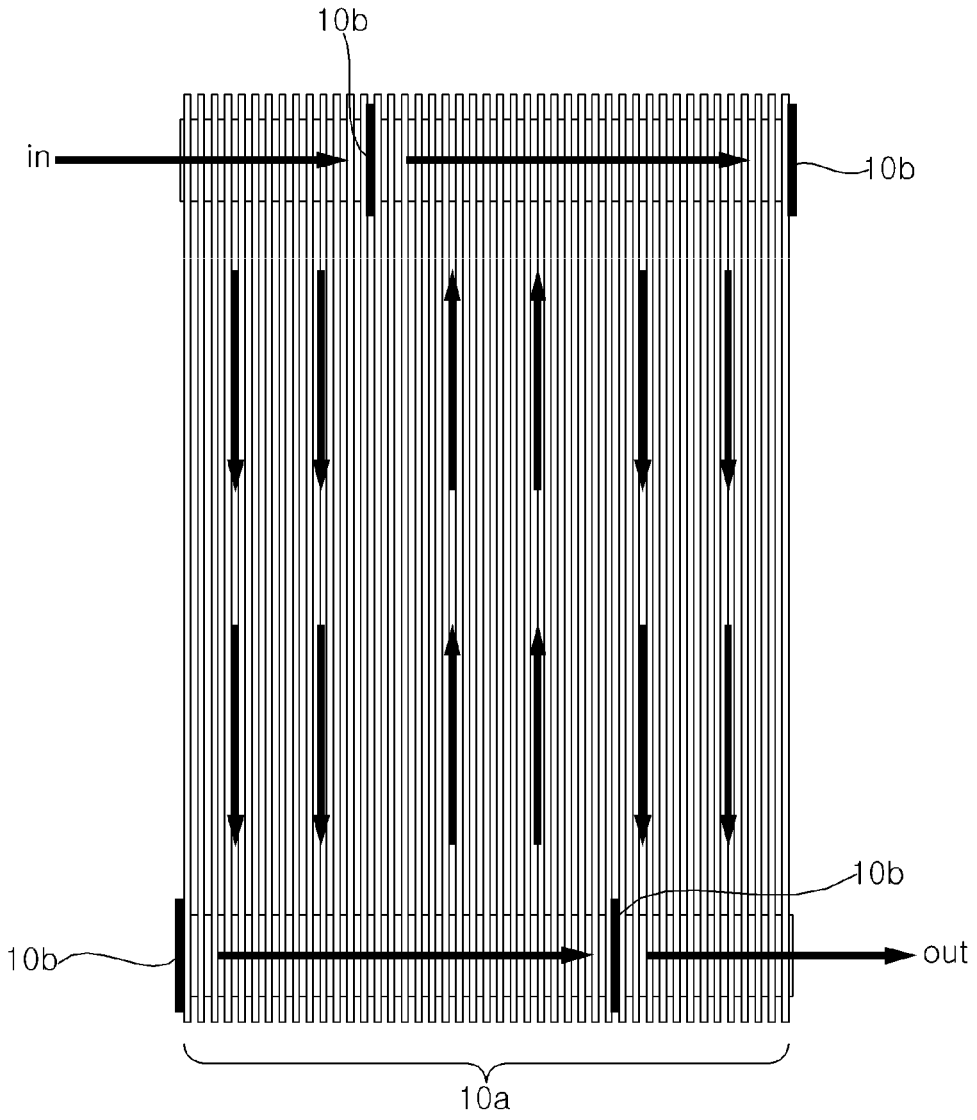

FIG. 8A to FIG. 8C illustrate examples of the configuration of fins when a heat exchanger is used as a condenser.

Figure 9A:
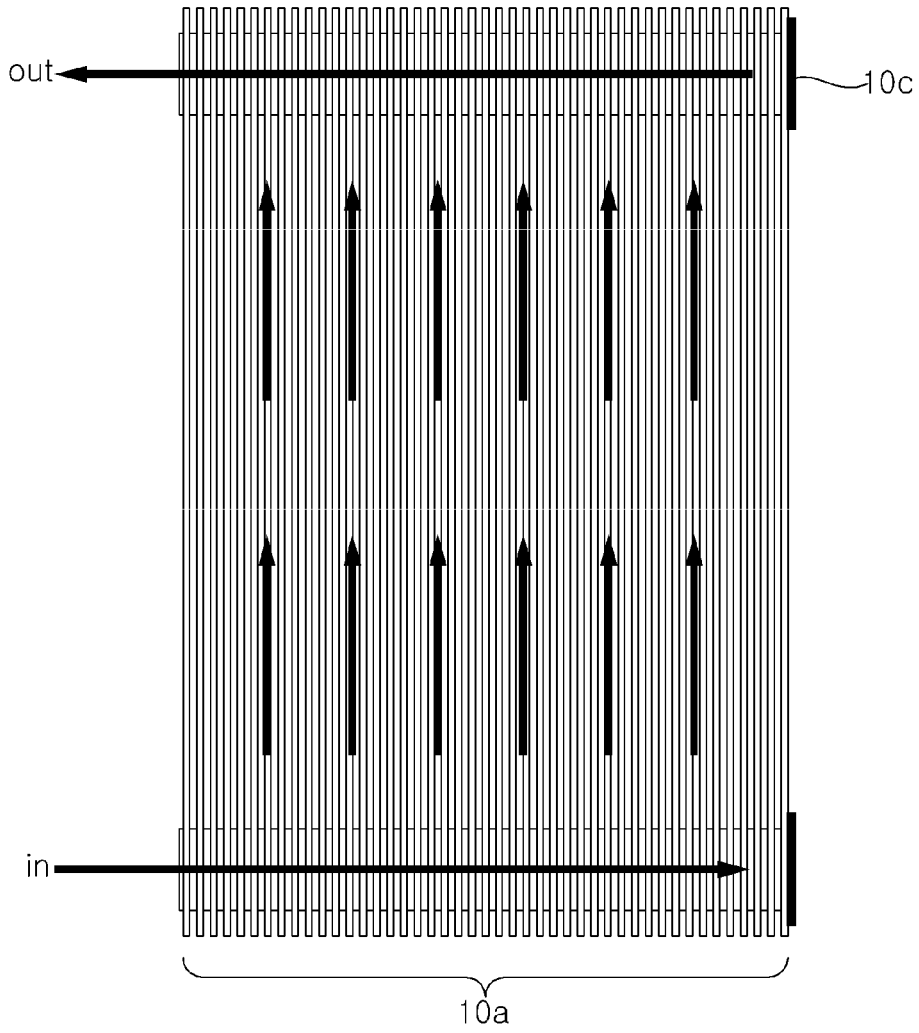
Figure 9B:
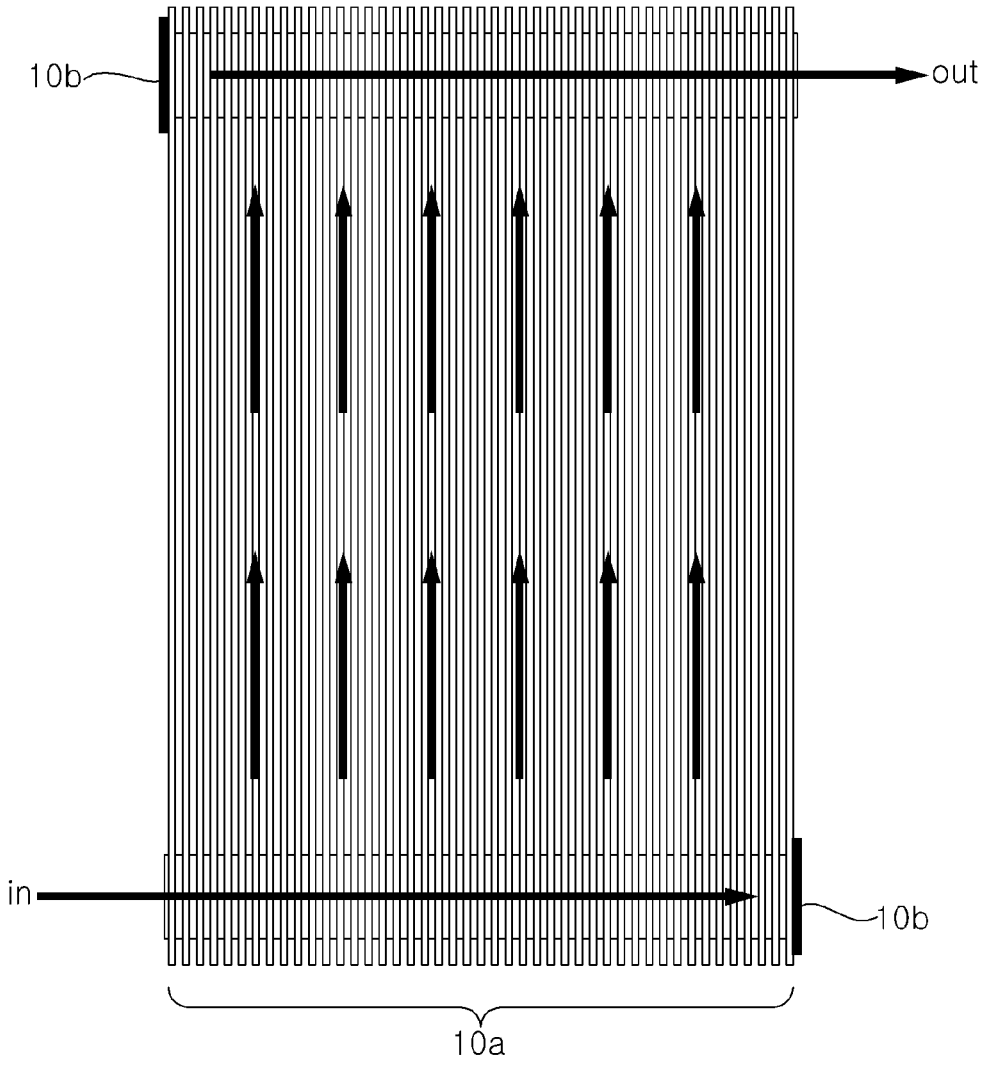
Figure 9C:
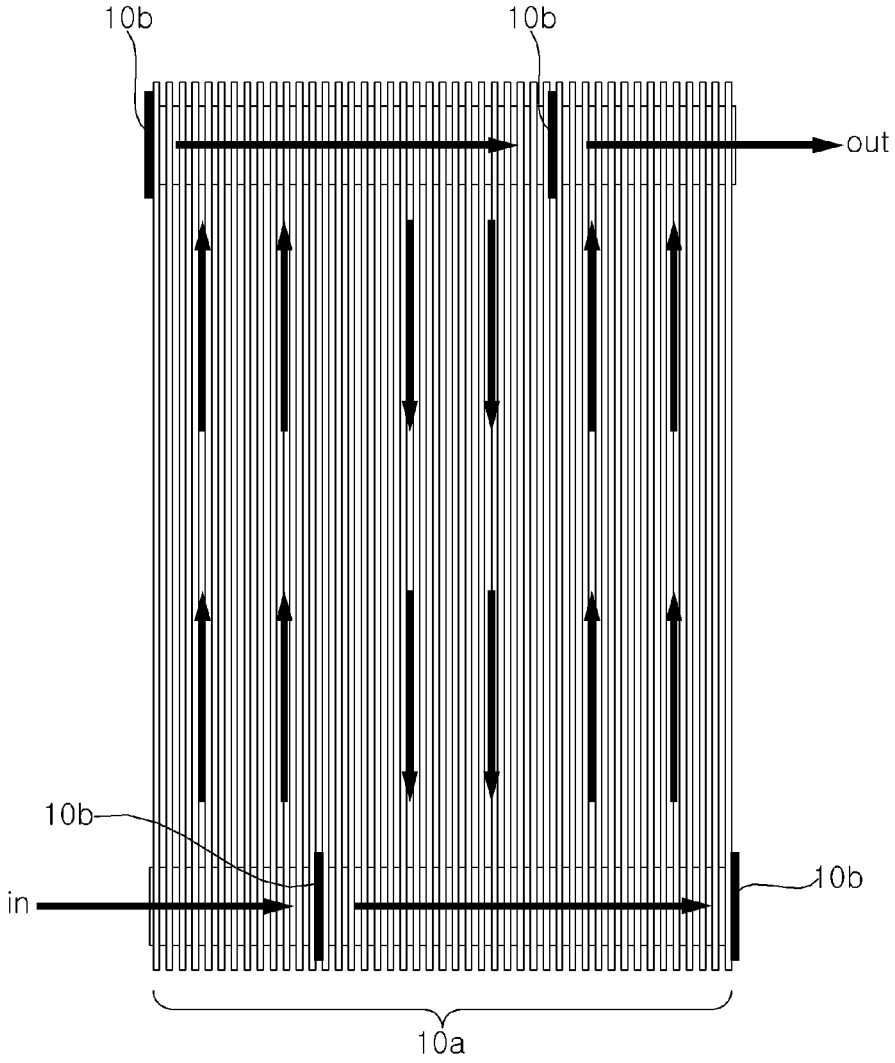

FIG. 9A to FIG. 9C illustrate examples of the configuration of fins when a heat exchanger is used as an evaporator.

DETAILED DESCRIPTION

The above and other aspects, features and other advantages of the present disclosure will be more clearly understood from the following detailed description taken in conjunction with the accompanying drawings. Exemplary embodiments will now be described more fully hereinafter with reference to the accompanying drawings; however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Spatially relative terms such as "below", "beneath", "lower", "above", "upper", etc., can be used to easily describe the correlation between one component and another component as shown in the drawing. Spatially relative terms should be understood as including different directions of components at the time of use or operation in addition to the directions shown in the drawing. For example, when reversing a spherical element shown in the drawing, a component described as "below" or "beneath" of another component may be placed "above" another component. Thus, the illustrative term "below" may include both the lower and the above directions. Components can also be oriented in different directions, so that spatially relative terms can be interpreted according to the orientation.

The terms herein are merely used to describe various embodiments of the present disclosure but are not intended to limit the present disclosure. Singular forms are intended to include plural forms unless the context clearly indicates otherwise. The terms "comprise" and/or "comprising" used in this specification do not exclude presence or addition of one or more other constituents, steps and/or operations in addition to the stated constituent, step, and/or operation.

Unless otherwise defined herein, all terms (including scientific and technical terms) used in the present specification may have meanings commonly understood by those skilled in the art. Such terms as those defined in a generally used dictionary are to be interpreted to have the same meanings as the contextual meanings in the relevant field of art, and are not to be interpreted to have ideal or excessively formal meanings unless clearly defined in the present disclosure.

In the drawings, the thickness or size of each constituent is exaggerated, omitted, or schematically illustrated for ease description and clarity. In addition, the size or area of each constituent does not completely reflect the real size or area thereof.

In addition, angles and directions referred in description of structures of embodiments are based on the illustrations of the drawings. In the case that a reference point or a reference position for an angle is not clearly stated in description of structures forming the embodiments, refer to the relevant drawings.

Hereinafter, the present disclosure will be described in detail with reference to the accompanying drawings.

Figure 1:
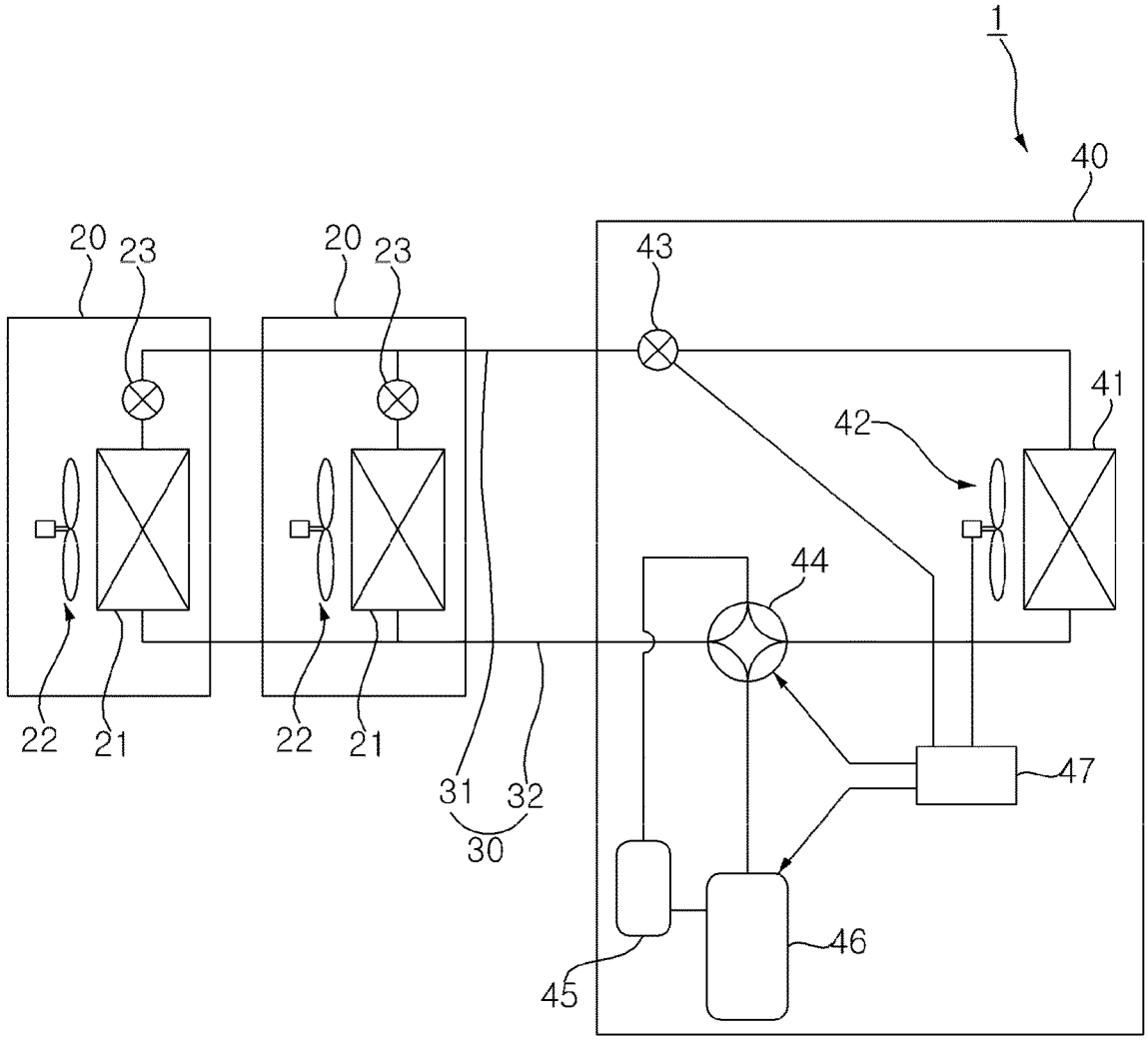
FIG. 1 is a schematic diagram of an air conditioner according to an embodiment of the present disclosure.

FIG. 1 is a schematic diagram of an air conditioner in heating operation, according to an embodiment of the present disclosure.

As shown in FIG. 1, an air conditioner 1 includes an outdoor unit 40 that is provided in an outdoor space, a plurality of indoor units 20 that are provided in an indoor space, and refrigerant pipes 31 and 32 that connect the outdoor unit 40 and the plurality of indoor units 20 to allow a refrigerant to circulate between the outdoor unit 10 and the plurality of indoor units 20.

In this embodiment, two indoor units 20 are connected to one outdoor unit 40. However, this is merely an example, and the present disclosure is not limited thereto. That is, one indoor unit 20 may be connected to one outdoor unit 40, or three or more indoor units 20 may be connected to one outdoor unit 40.

The outdoor unit 40 includes an outdoor heat exchanger 41 configured to exchange heat between outdoor air and a refrigerant, an outdoor blower 42 configured to allow the outdoor air to pass through the outdoor heat exchanger 41, a compressor 46 configured to compress a refrigerant, a four-way valve 44 configured to guide the refrigerant discharged from the compressor 46 to one of the outdoor unit 40 and the indoor units 20, an outdoor expansion valve 43 configured to decompress and expand the refrigerant, and an accumulator 45 configured to separate a liquid refrigerant from the refrigerant introduced into the compressor 46 to allow the liquid refrigerant to be vaporized and introduced into the compressor 46.

The outdoor unit 40 further includes a controller 47 to control the operation of the outdoor blower 42, the outdoor expansion valve 43, the compressor 46, and the four-way valve 44. The controller 47 may be configured as a microcomputer or the like.

The indoor unit 20 includes an indoor heat exchanger 21 configured to exchange heat between indoor air and a refrigerant, an indoor blower 22 configured to allow the indoor air to pass through the indoor heat exchanger 21, and an indoor expansion valve 23 configured to decompress and expand the refrigerant.

A refrigerant pipe 30 includes a liquid refrigerant pipe 31 through which a liquid refrigerant passes, and a gaseous refrigerant pipe 32 through which a gaseous refrigerant passes. The liquid refrigerant pipe 31 allows the refrigerant to flow between the indoor expansion valve 23 and the outdoor expansion valve 43.

The gaseous refrigerant pipe 32 guides the refrigerant to flow between the four-way valve 44 of the outdoor unit 40 and the gas side of the indoor heat exchanger 21 of the indoor unit 20.

Any one of HC refrigerant, HC mixed refrigerant, R32, R410A, R407C, and carbon dioxide may preferably be used as a refrigerant in the air conditioner.

Figure 3:
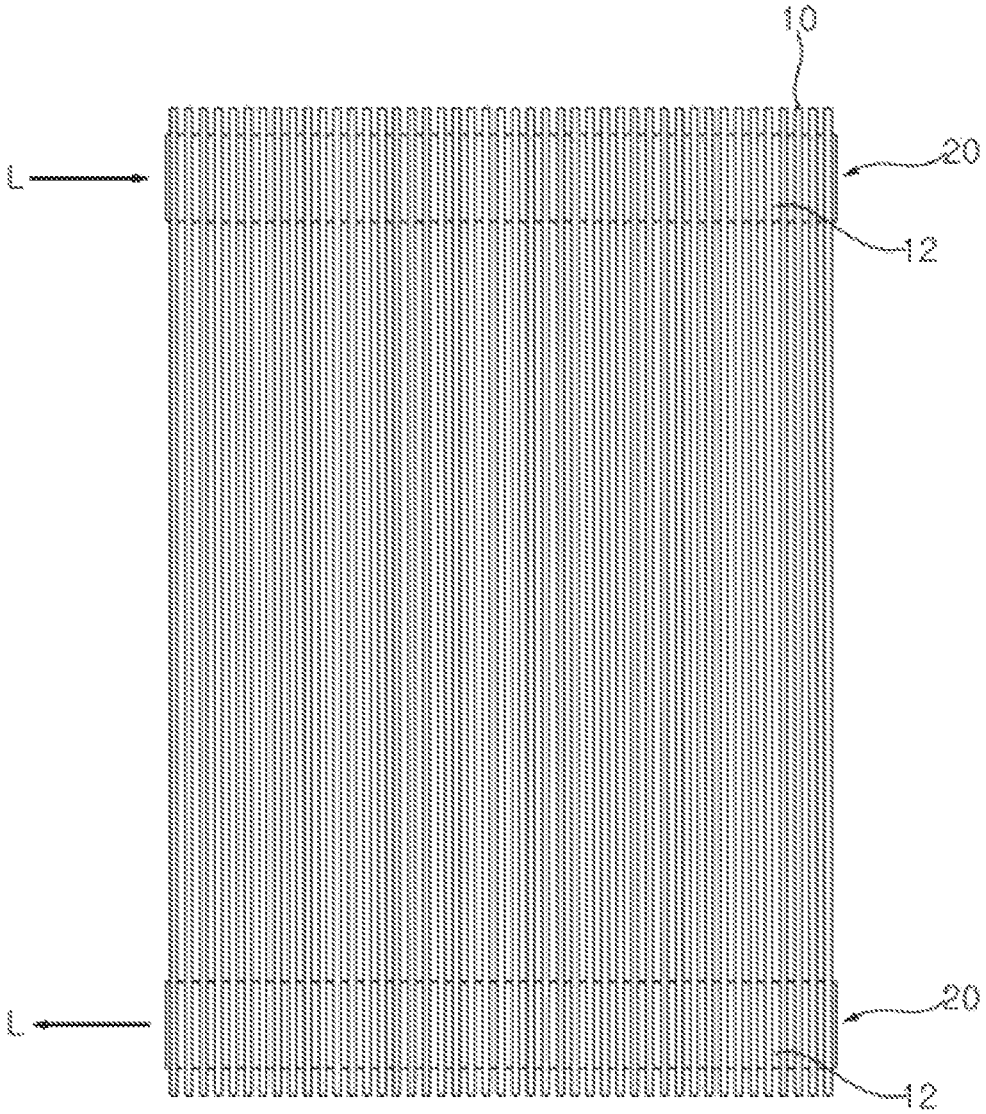
FIG. 3 is a side view of the heat exchanger of FIG. 2.
Figure 4:
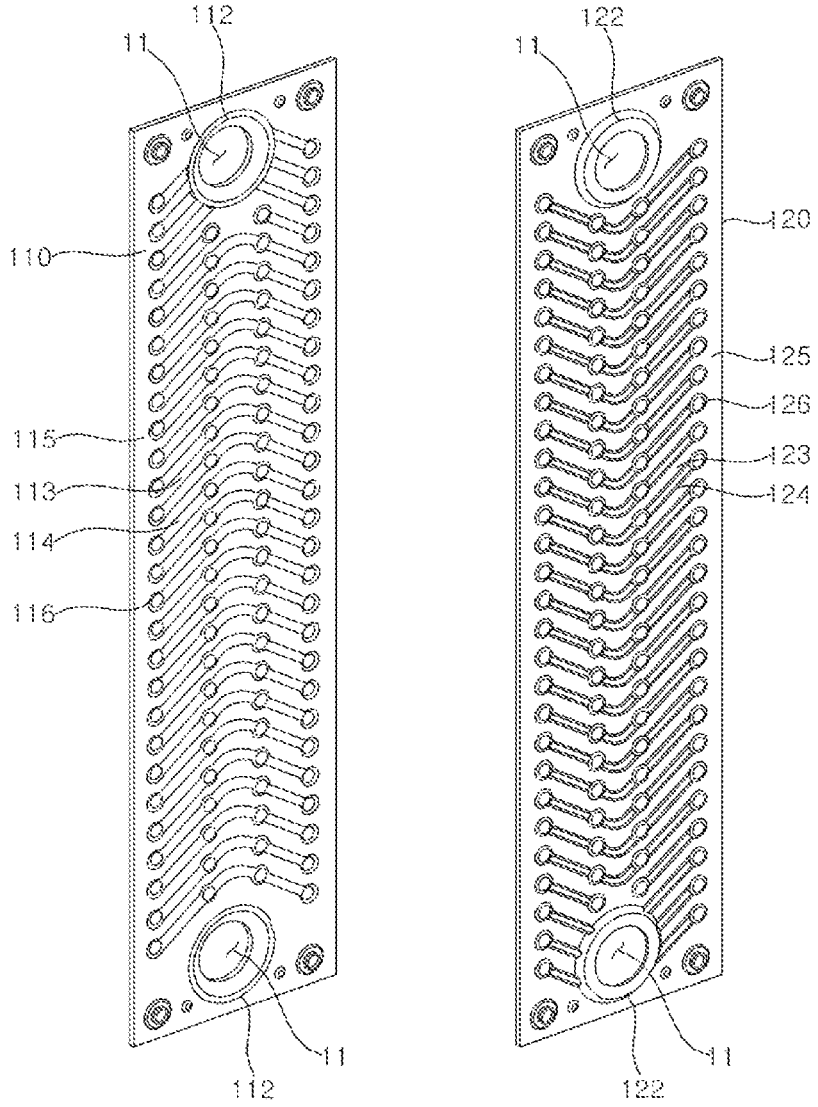
FIG. 4 is a diagram for explaining coupling of one fin of the heat exchanger of FIG. 2.
Figure 5:
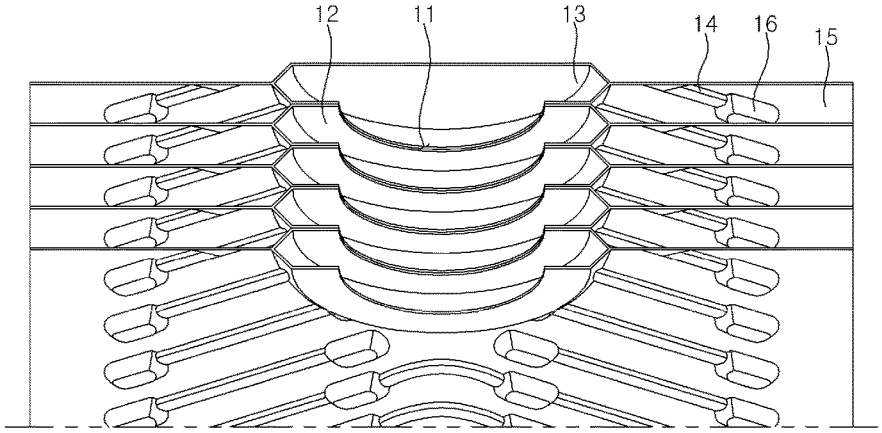
FIG. 5 is a cross-sectional view taken along line 5-5 of the heat exchanger of FIG. 2.

FIG. 2 is a perspective view of a heat exchanger according to an embodiment of the present disclosure; FIG. 3 is a side view of the heat exchanger of FIG. 2; FIG. 4 is a diagram for explaining coupling of one fin of the heat exchanger of FIG. 2; FIG. 5 is a cross-sectional view taken along line 5-5 of the heat exchanger of FIG. 2; and (a) of FIG. 6 illustrates a first panel and a second panel that define one fin and (b) of FIG. 6 illustrates one fin formed by coupling the first panel and the second panel.

Referring to FIGS. 2 and 3, a heat exchanger according to an embodiment of the present disclosure may include a fin 10 elongated vertically. The fin 10 may be provided in plurality, and the plurality of fins 10 may be arranged at intervals in one direction. A flow path through which a refrigerant flows may be formed in the fin 10.

A header 20 may be provided in pair, and the pair of headers 20 may be disposed at opposite end portions of the plurality of fins 10. The opposite end portions may be an upper end portion and a lower end portion in an up-and-down or vertical direction. The header 20 may be in communication with the flow paths formed in the plurality of fins 10.

Accordingly, a refrigerant may be introduced into one header 20 of the pair of headers 20, then may pass through the flow paths in the respective plurality of fins 10, and then may be discharged to the other header 20 of the pair of headers 20. Air may exchange heat with the flowing refrigerant that passes between the plurality of fins 10 and between the pair of headers 20.

Referring to FIG. 4, an opening portion or opening 11 may be provided in pair, and the pair of openings 11 may be formed adjacent to opposite ends of the fin 10, respectively. The opening 11 may be in communication with the flow path formed in the fin 10. The opening 11 may have a circular shape.

A fin collar 12 may be provided in pair, and the pair of fin collars 12 may surround the pair of openings 11, respectively. The fin collar 12 may extend in a direction in which the plurality of fins 10 are arranged. The fin collar 12 may have a circular shape surrounding the opening 11. The fin collar 12 may be in communication with the opening 11. When the plurality of fins 10 are arranged, the fin collar 12 may be connected between each of the plurality of fins 10 to thereby define a header 20 (see FIG. 3).

A refrigerant may flow in the opening 11 inside the fin collar 12. The refrigerant may be introduced into the fin 10 through the fin collar 12 or may be discharged from the fin 10 through the fin collar 12.

Referring to FIG. 4 to FIG. 6, one fin 10 may be achieved by coupling two panels 110 and 120.

As shown in (b) of FIG. 6, a plurality of grooves 14 are formed in one fin 10 formed by coupling two panels 110 and 120.

The groove 14 may be formed between a pair of fin collars 12 in one fin 10. The groove 14 may protrude to an outside of the fin 10, so that a flow path through which a refrigerant flows is formed inside the fin 10. The flow path defined by the groove 14 may be in communication with the opening 11.

The groove 14 may extend in a direction inclined with respect to a longitudinal direction of the fin 10. The groove 14 may extend in a direction inclined with respect to an air flow direction. The plurality of grooves 14 may be arranged along the longitudinal direction of the fin 10.

Each of the plurality of fins 10 may be formed by coupling a first panel 110 and a second panel 120. The first panel 110 and the second panel 120 may be bonded together at an outer portion 15 formed around an edge of the fin 10.

The first panel 110 and the second panel 120 may each have the shape of a plate elongated vertically. The first panel 110 and the second panel 120 may be coupled so that flat portions thereof face each other. A flow path through which a refrigerant flows may be formed between the first panel 110 and the second panel 120.

As shown in FIG. 4 and (a) of FIG. 6, the first panel 110 may include a plurality of first grooves 114. The first groove 114 may be formed by protruding outward from the first panel 110. The first groove 114 may extend in a direction inclined with respect to a longitudinal direction of the first panel 110. The plurality of first grooves 114 may be arranged along the longitudinal direction of the first panel 110.

The second panel 120 may include a plurality of second grooves 124. The second groove 124 may be formed by protruding outward from the second panel 120. The second groove 124 may extend in a direction inclined with respect to a longitudinal direction of the second panel 120. The plurality of second grooves 124 may be arranged along the longitudinal direction of the second panel 120.

The second groove 124 may protrude in a direction opposite to the first groove 114. The second groove 124 may extend in a direction intersecting the first groove 114. When the first panel 110 and the second panel 120 are coupled to each other, the first groove 114 and the second groove 124 may face each other to thereby define therein a flow path through which a refrigerant flows.

A plurality of dimples 116, 126 may be formed in the respective grooves 114 and 124 of the first panel 110 and the second panel 120.

The plurality of dimples 116, 126 may be configured as circular recessed portions, each having a diameter greater than a width of the groove 114, 124. At least two dimples (116, 126), and preferably, four dimples (116, 126) may be formed in one groove (114, 124).

That is, for one groove (114, 124), a dimple (116, 126) may be provided at each of its ends, and two dimples (116, 126) may be further provided at its middle portion at an interval from each other.

Meanwhile, the pair of fin collars 12 may include a pair of first fin collars 112 formed on the first panel 110 and a pair of second fin collars 122 formed on the second panel 120.

As shown in FIG. 5, the pair of headers 20 may be formed as a pair of first fin collars 112 formed on one fin 10, of the plurality of fins 10, and a pair of second fin collars 122 formed on another fin 10 adjacent to the one fin 10 are coupled to each other in a successive manner. In other words, the first fin collar 112 formed on the first panel 110 may be coupled to the second fin collar 122 formed on the second panel 120 that faces the first panel 110 while being spaced apart from the first panel 110, and this coupling is achieved in succession to thereby define one header 20.

As for the first panel 110, a first flat portion 113 may be formed between the first grooves 114. The first flat portion 113 may be formed on the same plane as a first outer portion 115. The first groove 114 may protrude outward relative to the first flat portion 113. The first groove 114 and the first flat portion 113 may be alternately arranged along the longitudinal direction of the first panel 110.

As for the second panel 120, a second flat portion 123 may be formed between the second grooves 124. The second flat portion 123 may be formed on the same plane as a second outer portion 125. The second groove 124 may protrude outward relative to the second flat portion 123. The second groove 124 and the second flat portion 123 may be alternatively arranged along the longitudinal direction of the second panel 120.

The first panel 110 and the second panel 120 may be coupled to each other at the first outer portion 115 and the second outer portion 125. The first outer portion 115 and the second outer portion 125 may be bonded to each other to define the outer portion 15.

Referring to FIG. 6, the fin 10 according to an embodiment of the present disclosure may be formed by coupling the first panel 110 and the second panel 120. The groove 14 may be bent at a bending section B.

The first panel 110 may include a first bending section B1 where the first groove 114 is bent with respect to the air flow direction. The second panel 120 may include a second bending section B2 where the second groove 124 is bent with respect to the air flow direction. The first bending section B1 and the second bending section B2 may be disposed at positions corresponding to each other.

The first groove 114 may be bent at the first bending section B1. The first groove 114 may be inclined with respect to the longitudinal direction of the first panel 110, while being reversely inclined from the first bending section B1.

For example, the first groove 114 may be inclined upward to the first bending section B1 along the air flow direction, and then may be inclined downward from the first bending section B1.

The second groove 124 may be bent at the second bending section B2. The second groove 124 may be inclined with respect to the air flow direction, while being reversely inclined from the second bending section B2.

For example, the second groove 124 may be inclined downward to the second bending section B2 along the air flow direction, and then may be inclined upward from the second bending section B2.

The first groove 114 and the first flat portion (113*a*, 113*b*) may be alternatively arranged along the longitudinal direction of the first panel 110. The second groove 124 and the second flat portion (123*a*, 123*b*) may be alternatively arranged along the longitudinal direction of the second panel 120.

The first groove 114 and the second groove 124 may face each other to thereby define a flow path. The first groove 114 and the second groove 124 may be disposed to be inclined in a direction intersecting each other.

The first bending section B1 and the second bending section B2 may be disposed in parallel with each other. The first bending section B1 and the second bending section B2 may be disposed parallel to the longitudinal direction of the fin 10.

The first bending section B1 and the second bending section B2 may each be provided in plurality. The plurality of first bending sections B1 and the plurality of second bending sections B2 may be arranged along the air flow direction.

The first groove 114 may be bent at each of the plurality of first bending sections B1. The second groove 124 may be bent at each of the plurality of second bending sections B2.

Accordingly, the area where the air and refrigerant flowing between the plurality of grooves 14 exchange heat may be increased.

In addition, the plurality of dimples 116, 126 may be configured as circular recessed portions, each having a diameter greater than a width of the groove 114, 124. At least two dimples (116, 126), and preferably four dimples (116, 126) may be formed in one groove (114, 124).

That is, for one groove (114, 124), a dimple (116, 126) may be provided at each of its ends, and two dimples (116, 126) may be further provided at its middle portion at an interval from each other to be symmetrical with respect to the bending section (B1, B2).

Thus, four dimples (116, 126) provided in one groove (114, 124) of each panel (110, 120) are formed symmetrically with respect to the bending section (B1, B2).

Due to the dimples 116, 126, pressure loss may be reduced.

As the header and the flow path are formed by the plurality of fins 10 stacked one another, a header-fin-flow path integrated heat exchanger is achieved.

Here, the heat exchanger of the present disclosure may change the flow path by employing various fins 10 as necessary, as shown in FIG. 7.

FIG. 7A to FIG. 7C illustrate fins with different headers employed in the heat exchanger of FIG. 2.

FIG. 7A illustrates a basic fin, FIG. 7B illustrates a series flow fin in which only one opening of two openings is open, and FIG. 7C illustrates a closed fin in which two openings are both closed.

The heat exchanger according to an embodiment of the present disclosure includes various shapes of fins available for changing the flow path, depending on the role of the heat exchanger or the installation environment.

As for the various shapes of fins of FIG. 7A to FIG. 7C, the configuration of a groove 14 and a flat portion 15 between two openings 11 is the same as that of FIG. 2 to FIG. 6.

In the case of a basic fin 10*a* of FIG. 7A, an opening 11 at its upper portion and an opening 11 at its lower portion are both open, so that the refrigerant introduced into one opening 11 passes through the flat portion 15 and the groove 14 and then is discharged through the other opening 11.

In the case of a series flow fin 10*b* of FIG. 7B, one of an opening 11 at its upper portion and an opening 11 at its lower portion is open. As one opening 11 is closed, continuous opening of the openings 11 defining the header 12 for the plurality of fins 10 is cut off. Accordingly, the flow of refrigerant is interrupted by the closed opening 11, allowing a flow path of the refrigerant to increase or extend serially.

As some of the plurality of fins 10 are connected serially in a parallel refrigerant flow arrangement, an extension of the flow path is achieved, thereby preventing refrigerant distribution imbalance due to an increase in size of the heat exchanger.

By connecting the series flow fin 10*b* to a position in which the refrigerant is stagnant without flowing, the direction of the flow path is changed to cause the stagnant refrigerant to be pushed, thereby addressing the refrigerant imbalance.

In the case of a closed fin 10*c* of FIG. 7C, an opening 11 at its upper portion and an opening 11 at its lower portion are both closed, thereby being used as an end plate. This allows the contact area to be increased compared to the conventional end plate. As a result, the wettability of filler metal is increased to enable stable brazing. Therefore, such a closed fin 10*c* is mainly used as an end plate.

As such, by variously arranging fins of different shapes depending on the purpose of their use, the flow path may vary according to the role (or function) of the heat exchanger.

In one example, the heat exchanger of the present disclosure may have different arrangements and configurations of fins when used as a condenser and when used as an evaporator.

This will be described below with reference to FIGS. 8 and 9.

FIG. 8A to FIG. 8C illustrate examples of the configuration of fins when a heat exchanger is used as a condenser, and FIG. 9A to FIG. 9C illustrate examples of the configuration of fins when a heat exchanger is used as an evaporator.

In the case of FIG. 8A, a plurality of fins 10 are stacked to perform brazing of collars 12, thereby forming a header 20.

Here, an opening 11 at the upper left side may be used as a refrigerant inlet (in), and an opening 11 at the lower left side may be used as a refrigerant outlet (out).

Meanwhile, as shown in FIG. 8B, an opening 11 at the upper left side may be used as a refrigerant inlet (in), and an opening 11 at the lower right side may be used as a refrigerant outlet (out).

When the refrigerant inlet (in) and the refrigerant outlet (out) are formed on the same side, as shown in FIG. 8A, a fin on one side, where the inlet (in) and the outlet (out) are formed, is configured as a basic fin 10*a*, and a fin on the other (or opposite) side, where the inlet (in) and the outlet (out) are not formed, is configured as a closed fin 10*c*.

Accordingly, the refrigerant flows from the other side to the outlet (out) through the header 20.

Meanwhile, when the refrigerant inlet (in) and the refrigerant outlet (out) are formed on different sides, fins on the respective sides provided with the inlet (in) and the outlet (out) are both configured as a series flow fin 10*b*, as shown in FIG. 8B.

All fins, except the series flow fin 10*b* or the closed fin 10*c* of FIG. 8A and FIG. 8B, are configured as basic fins 10*a*.

When the heat exchanger is used as a condenser, a refrigerant exchanges heat with low temperature outside air, and accordingly, the specific volume decreases as heat of the refrigerant is released as the heat exchange progresses. Thus, when a flow of refrigerant directed from bottom to top is formed, the specific volume is further reduced, causing an increase in refrigerant pressure loss due to gravity.

Therefore, when the heat exchanger is used as a condenser, a flow path directed from top to bottom is formed.

In addition, due to an increase in size of the heat exchanger, the refrigerant flow rate on the refrigerant inlet (in) side of FIG. 8A or FIG. 8B is very high, while the refrigerant flow rate on the opposite side is very small, causing flow rate imbalance in the entire flow path.

In order to prevent such refrigerant flow rate imbalance, the series flow fin 10*b* is inserted into a part of the heat exchanger.

When a series flow fin 10*b* is disposed between basic fins 10*a*, as shown in FIG. 8C, the flow of refrigerant flowing from a closed opening 11 of the series flow fin 10*b* to the header 20 is changed to a series flow.

As such, the refrigerant introduced into an inlet (in), as shown in FIG. 8C, flows downward, because its further entry is blocked by a closed opening 11 of a first series flow fin 10*b*, and then flows upward through a lower header 20. In this case, when a second series flow fin 10*b* is provided, the inflow of refrigerant into an adjacent fin is blocked due to a closed opening 11 of the second series flow fin 10*b* being disposed on the lower side.

When the first and the second series flow fins 10*b* are provided, the length of the refrigerant flow path is increased twice as long as that of the original flow path.

Thus, the refrigerant may flow evenly or uniformly without any refrigerant stagnant zone.

In addition, the series flow fin 10*b* is also provided at each of one side and the other side, so that the one side is provided with a refrigerant inlet (in) and the other side is provided with a refrigerant outlet (out).

When the heat exchanger is used as a condenser, the position of the series flow fin 10*b* is adjusted such that a length of the flow path through which the refrigerant flows from top to bottom is greater than that of the flow path through which the refrigerant flows from bottom to top.

FIG. 9A to FIG. 9C illustrate examples of the configuration of fins when a heat exchanger is used as an evaporator.

In the case of FIG. 9A, a plurality of fins 10*a*, 10*b*, 10*c* are stacked to perform brazing of collars 12, thereby forming a header 20.

Here, an opening 11 at the lower left side may be used as a refrigerant inlet (in), and an opening 11 at the upper left side may be used as a refrigerant outlet (out).

Meanwhile, as shown in FIG. 9B, an opening 11 at the lower left side may be used as a refrigerant inlet (in), and an opening 11 at the upper right side may be used as a refrigerant outlet (out).

When the refrigerant inlet (in) and the refrigerant outlet (out) are formed on the same side, as shown in FIG. 9A, a fin on one side, where the inlet (in) and the outlet (out) are formed, is configured as a basic fin 10*a*, and a fin on the other (or opposite) side, where the inlet (in) and the outlet (out) are not formed, is configured as a closed fin 10*c*.

Accordingly, the refrigerant flows from the other side to the outlet (out) through the header 20.

Meanwhile, when the refrigerant inlet (in) and the refrigerant outlet (out) are formed on different sides, fins on the respective sides provided with the inlet (in) and the outlet (out) are both configured as a series flow fin 10*b*, as shown in FIG. 9B.

All fins, except the series flow fin 10*b* or the closed fin 10*c* of FIG. 9A and FIG. 9B, are configured as basic fins 10*a*.

When the heat exchanger is used as an evaporator, a refrigerant exchanges heat with high temperature outside air, and accordingly, the specific volume increases as the heat exchange progresses. Thus, when a flow of refrigerant directed from top to bottom is formed, a lighter gaseous refrigerant becomes stagnant at the top without flowing downward, causing obstruction in the flow. In order to prevent such refrigerant stagnation, a flow path through which the refrigerant flows from bottom to top is formed.

Meanwhile, due to an increase in size of the heat exchanger, the refrigerant flow rate on the refrigerant inlet (in) side of FIG. 9A or FIG. 9B is very high, while the refrigerant flow rate on the opposite side is very small, causing flow rate imbalance in the entire flow path.

In order to prevent such refrigerant flow rate imbalance, the series flow fin 10*b* is inserted into a part of the heat exchanger.

When a series flow fin 10*b* is disposed between basic fins 10*a*, as shown in FIG. 9C, the flow of refrigerant flowing from a closed opening 11 of the series flow fin 10*b* to the header 20 is changed to a series flow.

As such, the refrigerant introduced into an inlet (in), as shown in FIG. 9C, flows upward, because its further entry is blocked by a closed opening 11 of a first series flow fin 10*b*, and then travels rightward through an upper header 20 and flows downward. In this case, when a second series flow fin 10*b* is provided, the inflow of refrigerant into an adjacent fin is blocked due to a closed opening of the second series flow fin 10*b* being disposed on the upper side.

When the first and the second series flow fins 10*b* are provided, the length of the refrigerant flow path is increased twice as long as that of the original flow path.

Thus, the refrigerant may flow evenly or uniformly without any refrigerant stagnant zone.

In addition, the series flow fin 10*b* is also provided at each of one side and the other side, so that the one side is provided with a refrigerant inlet (in) and the other side is provided with a refrigerant outlet (out).

When the heat exchanger is used as an evaporator, the position of the series flow fin 10*b* is adjusted such that a length of the flow path through which the refrigerant flows from bottom to top is greater than that of the flow path through which the refrigerant flows from top to bottom.

The heat exchanger of the present disclosure has one or more of the following effects.

The present disclosure can provide a fin-tube integrated heat exchanger that is easy to assemble, has high heat efficiency, and has low air flow resistance, which also enables a fin-tube-header integrated heat exchanger to be achieved.

Accordingly, a more compact heat exchanger can be implemented. In addition, various flow path designs are available by selectively opening an opening portion, which defines a header, of at least a part of a plurality of fins.

Thus, refrigerant flow imbalance can be suppressed or reduced, and the flow path can vary according to the role (or function) of the heat exchanger, thereby increasing the heat exchange efficiency.

In addition, as the position of a refrigerant inlet and a refrigerant outlet vary depending on the configuration of an inner space in which the heat exchanger is installed, an optimized heat exchanger can be provided.

Further, as fins with both headers closed are disposed at opposite ends to serve as end plates, the space utilization can be achieved without a dummy component, and the heat exchange efficiency can be improved.

Although embodiments have been described with reference to a number of illustrative embodiments thereof, it should be understood that numerous other modifications and embodiments can be devised by those skilled in the art that will fall within the scope of the principles of this disclosure. Therefore, the above detailed description should not be construed as restrictive in all respects and should be considered as illustrative.

What is claimed is:

1. A heat exchanger comprising:

a plurality of fins defining a flow path for a refrigerant to flow, each fin having an opening located in an upper portion thereof and an opening located in a lower portion thereof to allow the refrigerant to flow, each fin having a flow path portion therein to allow the refrigerant to flow, the plurality of fins being arranged at intervals in one direction; and an upper header provided at the upper portion of the plurality of fins, and a lower header provided at the lower portion of the plurality of fins, each header being in communication with the flow path portion, wherein at least one fin, among the plurality of fins, is configured such that at least one of the opening in the upper portion and the opening in the lower portion is closed, wherein each of the plurality of fins further includes a fin collar that surrounds a corresponding one of the openings, each fin collar protruding a predetermined thickness, wherein each header is defined by fin collars of adjacent fins of the plurality of fins being coupled to one another in a successive manner, wherein the plurality of fins include:

a plurality of basic fins, in which the opening in the upper portion and the opening in the lower portion are both open; and a plurality of series flow fins, in which one of the opening in the upper portion and the opening in the lower portion is open, the plurality of series flow fins including:

a first series flow fin;

a second series flow fin;

a third series flow fin disposed between the plurality of basic fins; and a fourth series flow fin disposed between the plurality of basic fins, wherein the plurality of basic fins are disposed between the first series flow fin and the second series flow fin, wherein the opening in the lower portion of the first series flow fin is closed, wherein the opening in the upper portion of the second series flow fin is closed, wherein the opening in the upper portion of the third series flow fin is closed, and wherein the opening in the lower portion of the fourth series flow fin is closed.

2. The heat exchanger of claim 1, wherein the plurality of fins further comprise a closed fin in which the opening in the upper portion and the opening in the lower portion are both closed.

3. The heat exchanger of claim 2, wherein each series flow fin is configured to change a flow of the refrigerant from a parallel flow to a series flow to thereby extend a length of the flow path for the refrigerant.

4. The heat exchanger of claim 2, wherein the closed fin defines an end plate of the heat exchanger.

5. The heat exchanger of claim 1, wherein, when the heat exchanger is operated as an evaporator, each series flow fin is disposed such that, in the flow path for the refrigerant, a section where refrigerant flows from bottom to top is greater than a section where refrigerant flows from top to bottom.

6. The heat exchanger of claim 1, wherein, when the heat exchanger is operated as an evaporator, at least two series flow fins of the plurality of series flow fins are disposed such that a portion of the flow path for the refrigerant flows from top to bottom.

7. The heat exchanger of claim 1, wherein each fin includes:

a first panel having a plurality of first grooves protruding outward from the first panel and extending in a direction inclined with respect to a longitudinal direction of the first panel, the plurality of first grooves being arranged along the longitudinal direction of the first panel, and a second panel coupled to the first panel, the second panel having a plurality of second grooves protruding outward from the second panel and extending in a direction intersecting the plurality of first grooves while being inclined with respect to a longitudinal direction of the second panel, the plurality of second grooves being arranged along the longitudinal direction of the second panel to face the plurality of first grooves to thereby define the flow path portion.

8. The heat exchanger of claim 7, wherein each fin collar includes:

a first fin collar on the first panel; and a second fin collar on the second panel.

9. The heat exchanger of claim 8, wherein the first panel comprises a first bending section where the first grooves are bent in a first direction with respect to an air flow direction, and wherein the second panel comprises a second bending section where the second grooves are bent in a second direction opposite to the first direction at a position corresponding to the first bending section.

10. The heat exchanger of claim 9, wherein the first bending section and the second bending section are arranged parallel to a longitudinal direction of the fin.

11. A heat exchanger comprising:

a plurality of fins provided therein with a flow path through which a refrigerant is configured to flow, the plurality of fins being arranged at intervals in one direction; and an upper header provided at an upper portion of the plurality of fins, and a lower header provided at a lower portion of the plurality of fins, each header being in communication with the flow path, wherein each of the plurality of fins has an opening in the upper portion and the lower portion thereof, and wherein each header is defined by the openings of adjacent fins, of the plurality of fins, being coupled to one another in a successive manner, wherein each of the plurality of fins further includes a fin collar that surrounds a corresponding one of the openings, each fin collar protruding a predetermined thickness, wherein each header is defined by fin collars of adjacent fins of the plurality of fins being coupled to one another in a successive manner, wherein the plurality of fins include:

a plurality of basic fins, in which the opening in the upper portion and the opening in the lower portion are both open; and a plurality of series flow fins, in which one of the opening in the upper portion and the opening in the lower portion is open, the plurality of series flow fins including:

a first series flow fin;

a second series flow fin;

a third series flow fin disposed between the plurality of basic fins; and a fourth series flow fin disposed between the plurality of basic fins, wherein the plurality of basic fins are disposed between the first series flow fin and the second series flow fin, wherein the opening in the lower portion of the first series flow fin is closed, wherein the opening in the upper portion of the second series flow fin is closed, wherein the opening in the upper portion of the third series flow fin is closed, and wherein the opening in the lower portion of the fourth series flow fin is closed.

* * * * *